US012246895B2

(12) United States Patent
Lindsey

(10) Patent No.: US 12,246,895 B2
(45) Date of Patent: Mar. 11, 2025

(54) SEAL INSERT MOLECULAR BONDED TO BOTTLE

(71) Applicant: Otium Sealing, Inc., Orange, CA (US)

(72) Inventor: Bryce Lindsey, Orange, CA (US)

(73) Assignee: OTIUM SEALING, INC., Orange, CA (US)

( * ) Notice: Subject to any disclaimer, the term of this patent is extended or adjusted under 35 U.S.C. 154(b) by 0 days.

(21) Appl. No.: 18/410,455

(22) Filed: Jan. 11, 2024

(65) Prior Publication Data

US 2024/0239574 A1 Jul. 18, 2024

Related U.S. Application Data

(60) Provisional application No. 63/479,836, filed on Jan. 13, 2023.

(51) Int. Cl.

| | |
|---|---|
| ***B65D 53/04*** | (2006.01) |
| ***B65B 7/28*** | (2006.01) |
| ***B65D 1/02*** | (2006.01) |
| ***B65D 51/22*** | (2006.01) |

(52) U.S. Cl.

CPC ..... *B65D 53/04* (2013.01); *B65B 7/2821* (2013.01); *B65B 7/2828* (2013.01); *B65B 7/2842* (2013.01); *B65D 1/0207* (2013.01); *B65D 1/0246* (2013.01); *B65D 51/221* (2013.01); *B65D 2251/0015* (2013.01); *B65D 2251/0093* (2013.01)

(58) Field of Classification Search

CPC .... B65D 47/103; B65D 53/04; B65D 51/221; B65D 2251/0015; B65D 2251/0093; B65D 1/0207; B65D 1/0246

USPC ..... 220/258.2

See application file for complete search history.

(56) References Cited

U.S. PATENT DOCUMENTS

| | | | | |
|---|---|---|---|---|
| 3,269,617 A * | 8/1966 | Goth | ..... | B65D 47/141 222/541.9 |
| 4,512,486 A * | 4/1985 | Kobayashi | ..... | B65D 47/103 222/541.9 |
| 4,819,819 A * | 4/1989 | Robertson, Jr. | ..... | B65D 47/103 215/230 |

(Continued)

FOREIGN PATENT DOCUMENTS

| | | |
|---|---|---|
| EP | 1034111 | 3/2004 |

*Primary Examiner* — Nathan J Jenness
*Assistant Examiner* — Jennifer Castriotta
(74) *Attorney, Agent, or Firm* — STETINA BRUNDA GARRED & BRUCKER

(57) ABSTRACT

A method of sealing a bottle includes providing a bottle having a bottle body, a neck, a bottle opening, and a bottle main cavity. The neck has a neck inner radial surface and an opposing neck outer radial surface. The neck has a neck annular top surface. The bottle is formed of a thermoplastic material. The method includes providing a seal insert having a cylindrical skirt, a circular flange, a pull-tab, and a sealing deck. The cylindrical skirt has an insert inner radial surface and an insert outer radial surface. The circular flange has a flange outer edge, a flange annular top surface and a flange annular bottom surface. The seal insert is formed of a thermoplastic material. The method includes molecular bonding the flange annular bottom surface directly to the neck annular top surface. The method includes providing a closure and attaching the closure to the bottle.

34 Claims, 8 Drawing Sheets

(56) References Cited

U.S. PATENT DOCUMENTS

| | | | | |
|---|---|---|---|---|
| 5,027,979 | A | 7/1991 | Kawajiri et al. | |
| 5,133,486 | A | 7/1992 | Moore et al. | |
| 5,735,426 | A | 4/1998 | Babcock et al. | |
| 5,915,574 | A | 6/1999 | Adams et al. | |
| 6,776,314 | B2 | 8/2004 | Odet | |
| 6,883,689 | B2 | 4/2005 | Odet | |
| 7,559,432 | B2 | 7/2009 | Mavin et al. | |
| 7,810,681 | B2 | 10/2010 | Lohrman et al. | |
| 7,832,579 | B2 | 11/2010 | Lohrman et al. | |
| 8,057,896 | B2 | 11/2011 | Smelko | |
| 2002/0033395 | A1* | 3/2002 | Iwano | B29C 66/81423 229/125.05 |
| 2009/0188887 | A1* | 7/2009 | Mavin | B65D 51/20 215/324 |
| 2009/0250469 | A1* | 10/2009 | Heiberger | B65D 47/242 215/44 |

* cited by examiner

SEAL INSERT MOLECULAR BONDED TO BOTTLE

CROSS-REFERENCE TO RELATED APPLICATIONS

This application relates to and claims the benefit of U.S. Provisional Patent Application No. 63/479,836 filed Jan. 13, 2023, and entitled "Seal Insert for Consumer Packaging" the entire disclosure of which is hereby wholly incorporated by reference.

STATEMENT RE: FEDERALLY SPONSORED RESEARCH/DEVELOPMENT

Not Applicable

BACKGROUND

1. Technical Field

The present disclosure relates generally to the field sealing of thermoplastic containers with complementary closures.

2. Related Art

Products used or consumed frequently by the general public are commonly considered to be part of the consumer packaged goods (CPG) market. While not fully exhaustive, examples of such products include: (i) nutritional products such as foods, beverages, supplements, nutraceuticals and medicine; (ii) personal hygiene products such as soaps, lotions, and creams; and (iii) homecare products such as detergents and cleaners. Such products are typically proportioned and packaged into a hermetically sealed container that fundamentally ensures the integrity of the product sold to the consumer.

A large segment of the CPG market utilizes a common packaging composition that consists of three physical packaging elements: (i) a thermoplastic container such as bottles, jars, or the like having exterior neck mating features such as threads, ledges, or the like at its open end; (ii) a thermoplastic closure or cap having mating features such as threads, ledges (such as for a pop top closure), or the like on its interior walls; and (iii) an intermediate seal element that is attached to the open end of the container thereby hermetically sealing product within. The mating features of the containers and closures enable the assembly to one another and a means to reclose the container.

Open containers and bottles are often used to package a variety of CPG products, such as food, liquid, beauty, nutraceutical, drug, automotive and other goods. Once a bottle or container is filled, it is usually sealed hermetically. Many packaged goods also require a visual tamper evidence cue that communicates to the consumer whether the package has been accessed before. This tamper evidence cue is often a mechanical interaction between the open container and the corresponding tamper evidence feature on a closure, sealing element, or the package's label.

Open containers and bottles often contain a neck at their end where the packaged product enters and is dispensed by the customer. The neck is composed of a top face as well as an inner wall, extending downward from the inner diameter of the top face, and an outer wall, extending downward from the outer diameter of the top face. The outer diameter of the top face is commonly referred to as the "E" dimension of the neck. The inner diameter of the top face is commonly referred to as the "I" dimensions of the neck. The neck often includes neck features on its outer wall often intended for compatibility with the intended closure or fill-line automation equipment. These neck features commonly include threads and a tamper evidence ledge or tab.

Closures are often used to seal and reseal an open container or bottle. Closures often consist of an inner wall, outer wall, and top deck. Closures may also contain a tamper evidence feature which interacts with the corresponding tamper evidence feature on a container. Closures may also include mechanical sealing features, such as a plug, gasket, beads, and other physical protrusions that mechanically compress against various parts of a container neck.

There are multitudes of like products within the CPG market that are produced and packaged by a multitude of manufacturers. It is widely known within the industry that there are established standards for the manufacture of the like or complementary physical packaging elements. These standardizations ensure compatibility of the packaging elements, independent of the manufacturer, and enable products to be packaged consistently and efficiently at mass scale.

In the common packaging composition, manufacturers of such containers and closures often utilize applicable industry standards in the manufacture of such elements. These standards are integral in establishing dimensional requirements for the exterior neck mating features of the container, as well as the interior mating features of the closure. This ensures functional compatibility of the two packaging elements independent of the manufacturer of such elements.

Manufacturers utilize seal elements that are predominantly planar-disc-shaped and are sized to be dimensionally compatible with the container and closures. These seal elements are often comprised of multi-layer material structures. In general, the lower sheet-like structure has a non-foam, heat-distributing layer thereon. The lower structure typically includes a metal foil support layer, typically aluminum, a polymer layer, and a heat activated sealant layer. The heat-activated sealant layer is generally provided under the bottom surface of the polymer layer. To initiate the bond of the sealant layer to the container, the metal foil support layer is heated to introduce thermal energy through the polymer layer to the sealant layer. Generally, seal elements also include a top structure which is typically laminated to the bottom structure. The top structure is generally formed of multiple layers of materials. These layers may be composed of polyethylene terephthalate (PET), silicone release coated PET, paper, nylon, foamed polymers, polypropylene (PP), or other polymers. During the bonding process, the top structure may partially or completely delaminate from the bottom structure.

Once sealed to a container, these planar-disc-shaped seal elements each have a minimal protrusion above the top face of the container and may also protrude radially beyond the container's outer diameter. The protrusions of the seal element do not prevent the interaction between the mating features of the container and closure, thereby ensuring the intended functional compatibility of the specified container and closure is not compromised. Prior to initial use or consumption of the given product, consumers are tasked with removing the seal element to break the seal. Due to the minimal physical protrusion(s) of the seal element, consumers routinely struggle, strain, or are unable to remove the seal element solely by use of their fingers or hands. This frustrating consumer experience often results in the consumer resorting to the use of a separate tool (e.g., teeth, knife, etc.) in order to puncture or peel away the seal element.

Therefore, there is a need in the art for an improved method and systems for providing a seal for a thermoplastic container and closure combination that improves the consumer experience while ensuring the intended functional compatibility of a specified container and closure is not compromised.

BRIEF SUMMARY

According to an aspect of the invention, there is provided a method of sealing a bottle. The method includes providing a bottle having a bottle body, a neck, a bottle opening, and a bottle main cavity extending into the bottle body from the bottle opening. The neck extends from the bottle body. The neck has a neck inner radial surface and an opposing neck outer radial surface. The neck has a neck annular top surface disposed between a neck inner edge and a neck outer edge. The neck outer radial surface extends from the neck outer edge. The neck inner radial surface extends from the neck inner edge. The bottle opening is defined by the neck inner edge. The bottle is formed of a thermoplastic material. The method further includes providing a seal insert having a cylindrical skirt, a circular flange, a pull-tab, and a sealing deck. The cylindrical skirt has an insert inner radial surface and an opposing insert outer radial surface. The circular flange radially extends from the insert outer radial surface. The circular flange has a flange outer edge, a flange annular top surface and an opposing flange annular bottom surface. The sealing deck extends across the cylindrical skirt from the insert inner radial surface. The pull-tab extends from the sealing deck within the insert inner radial surface. The seal insert is formed of a thermoplastic material formed via an injection molding process. The method further includes positioning the seal insert into the neck with the cylindrical skirt within the neck inner radial surface. The method further includes molecular bonding the flange annular bottom surface directly to the neck annular top surface to seal the bottle main cavity. The seal insert is formed to allow the seal insert to be torn with at least a portion of the sealing deck being separated from the cylindrical skirt upon a pulling force being applied to the pull-tab in a direction away from the bottle main cavity before the flange annular bottom surface being disengaged from the neck annular top surface. The method further includes providing a closure. The closure has a closure outer radial surface and an opposing closure inner radial surface, and a closure top extending radially interior from and across the closure inner radial surface. The neck outer radial surface and the closure inner radial surface are cooperatively formed to engage each other. The method further includes attaching the closure to the bottle by positioning the closure inner radial surface about the neck outer radial surface.

According to various embodiments, the seal insert may be formed of polyethylene. The seal insert may be formed of a single unitary piece of material. The seal insert may be formed of two types of thermoplastic material. The flange and the bottle neck may be formed by the same type of thermoplastic material. In an embodiment the flange outer edge does not radially extend beyond the neck outer radial surface with the seal insert positioned into the neck. The molecular bonding of the flange annular bottom surface may include directing energy into the flange. The molecular bonding of the flange annular bottom surface may include providing heat to the flange annular top surface. The molecular bonding of the flange annular bottom surface may include ultrasonic welding. The flange annular bottom surface may include a ring-shaped energy director extending away from the flange annular top surface to a distal circular apex. The positioning of the seal insert into the neck may include placing the distal circular apex against the neck annular top surface. The pull-tab may be ring-shaped. The neck outer radial surface may have outer threads extending therefrom and the closure inner radial surface has inner threads extending therefrom, and the attaching of the closure to the bottle includes rotating the closure onto the bottle with the outer threads engaged with the inner threads. The flange outer edge radially may extend between the neck outer radial surface and the outer threads with the seal insert positioned into the neck. The seal insert may include centering nubs circumferentially distributed about and extending radially from the insert outer radial surface, the centering nubs contacting the neck inner radial surface upon the seal insert being inserted into the neck. Each of the centering nubs may extend along the insert outer radial surface away from the circular flange, the centering nubs each are tapered with the tapering being a less radial distance in a direction away from the circular flange. The method may further include inserting a dispensable product into the bottle prior to positioning the seal insert into the neck. The dispensable product may be medicine. The molecular bonding of the flange annular bottom surface directly to the neck annular top surface may form a hermetic seal of the bottle main cavity.

According to another aspect of the invention, there is provided a sealed product packaging unit. The sealed product packaging unit includes a bottle having a bottle body, a neck, a bottle opening, and a bottle main cavity extending into the bottle body from the bottle opening. The neck extends from the bottle body. The neck has a neck inner radial surface and an opposing neck outer radial surface having outer threads extending therefrom. The neck has a neck annular top surface disposed between a neck inner edge and a neck outer edge. The neck outer radial surface extends from the neck outer edge. The neck inner radial surface extends from the neck inner edge. The bottle opening is defined by the neck inner edge. The bottle is formed of a thermoplastic material. The sealed product packaging unit further includes a seal insert having a cylindrical skirt, a circular flange, a pull-tab, and a sealing deck. The cylindrical skirt has an insert inner radial surface and an opposing insert outer radial surface. The circular flange radially extends from the insert outer radial surface. The circular flange has a flange outer edge, a flange annular top surface and an opposing flange annular bottom surface. The sealing deck extends across the cylindrical skirt from the insert inner radial surface. The pull-tab extends from the sealing deck within the insert inner radial surface. The seal insert is positioned into the neck with the cylindrical skirt within the neck inner radial surface. The flange annular bottom surface is directly molecularly bonded to the neck annular top surface to seal the bottle main cavity. The seal insert is formed to allow the seal insert to be torn with at least a portion of the sealing deck being separated from the cylindrical skirt upon a pulling force being applied to the pull-tab in a direction away from the bottle main cavity before the flange annular bottom surface being disengaged from the neck annular top surface. The seal insert is formed of an injection molded thermoplastic material. The sealed product packaging unit further includes a closure having a closure outer radial surface and an opposing closure inner radial surface, and a closure top extending radially interior from and across the closure inner radial surface. The closure is attachable to the bottle.

According to various embodiments, the seal insert may be formed of polyethylene. The seal insert may be formed of a single unitary piece of material. The seal insert may be formed of two types of thermoplastic material. The flange and the bottle neck may be formed by the same type of thermoplastic material. In an embodiment the flange outer edge does not radially extend beyond the neck outer radial surface with the seal insert positioned into the neck. The flange annular bottom surface may be directly molecularly bonded to the neck annular top surface by directing energy into the flange. The flange annular bottom surface may be directly molecularly bonded to the neck annular top surface by heating. The flange annular bottom surface may be directly molecularly bonded to the neck annular top surface by ultrasonic welding. The pull-tab may be ring-shaped. The flange outer edge may radially extend between the neck outer radial surface and the outer threads with the seal insert positioned into the neck. The seal insert may include centering nubs circumferentially distributed about and extending radially from the insert outer radial surface, the centering nubs contacting the neck inner radial surface upon the seal insert being inserted into the neck. Each of the centering nubs may extend along the insert outer radial surface away from the circular flange, and the centering nubs each may be tapered with the tapering being a less radial distance in a direction away from the circular flange.

BRIEF DESCRIPTION OF THE DRAWINGS

These and other features and advantages of the various embodiments disclosed herein will be better understood with respect to the following description and drawings, in which like numbers refer to like parts throughout, and in which.

DETAILED DESCRIPTION

Figure 1:
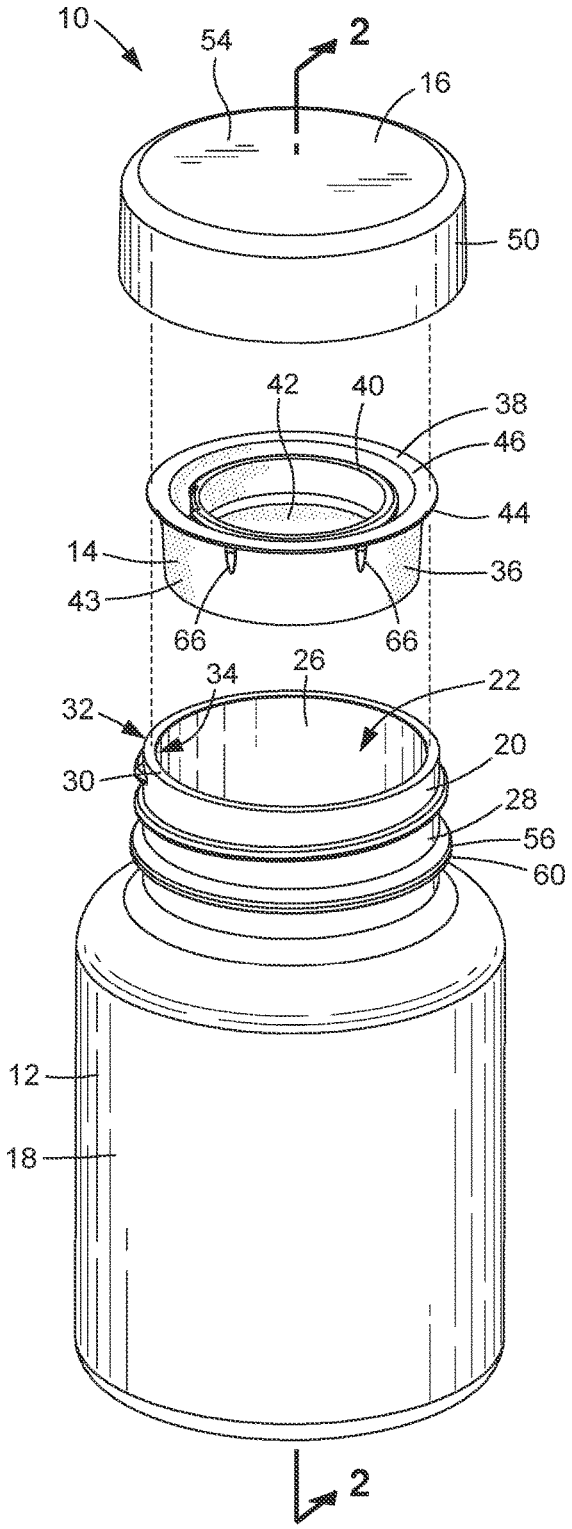
FIG. 1 is an exploded perspective view of a sealed product packaging unit according to an aspect of the invention.
Figure 2:
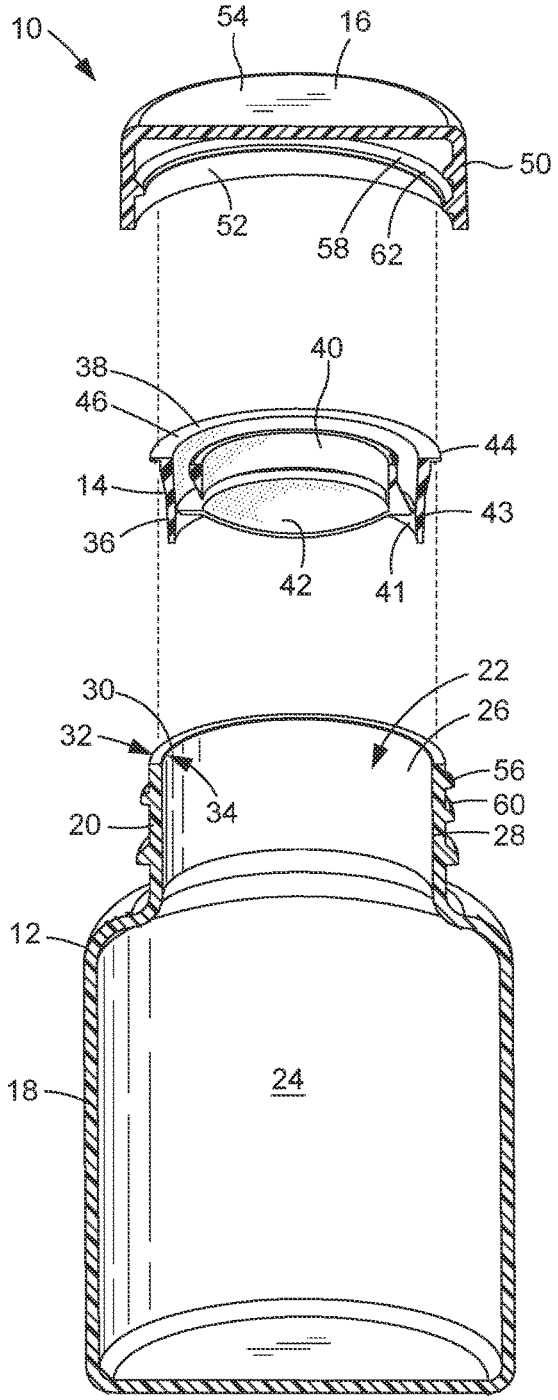
FIG. 2 is an exploded perspective view of the seal product packaging unit of FIG. 1 as viewed along axis 2-2 of FIG. 1.

The above description is given by way of example, and not limitation. Given the above disclosure, one skilled in the art could devise variations that are within the scope and spirit of the invention disclosed herein, including various ways of molecular bonding. Further, the various features of the embodiments disclosed herein can be used alone, or in varying combinations with each other and are not intended to be limited to the specific combination described herein. Thus, the scope of the claims is not to be limited by the illustrated embodiments.

Referring now to FIGS. 1-5 and 7-12, there is depicted a sealed product packaging unit 10 according to an aspect of the invention. As discussed in detail below, the sealed product packaging unit 10 includes a bottle 12, a seal insert 14 and a closure 16. The sealed product packaging unit 10 includes the bottle 12 having a bottle body 18, a neck 20, a bottle opening 22, and a bottle main cavity 24 extending into the bottle body 18 from the bottle opening 22. The neck 20 extends from the bottle body 18. The neck 20 has a neck inner radial surface 26 and an opposing neck outer radial surface 28. The neck 20 has a neck annular top surface 30 disposed between a neck inner edge 34 and a neck outer edge 32. The neck outer radial surface 28 extends from the neck outer edge 32. The neck inner radial surface 26 extends from the neck inner edge 34. The bottle opening 22 is defined by the neck inner edge 34. The bottle 12 is formed of a thermoplastic material.

The sealed product packaging unit 10 further includes the seal insert 14 having a cylindrical skirt 36, a circular flange 38, a pull-tab 40, and a sealing deck 42. The cylindrical skirt 36 has an insert inner radial surface 41 and an opposing insert outer radial surface 43. The circular flange 38 radially extends from the insert outer radial surface 43. The circular flange 38 has a flange outer edge 44, a flange annular top surface 46 and an opposing flange annular bottom surface 48. The sealing deck 42 extends across the cylindrical skirt 36 from the insert inner radial surface 41. The pull-tab 40 extends from the sealing deck 42 within the insert inner radial surface 41. The seal insert 14 is positioned into the neck 20 with the cylindrical skirt 36 within the neck inner radial surface 26. The flange annular bottom surface 48 is directly molecularly bonded to the neck annular top surface 30 to seal the bottle main cavity 24. The seal insert 14 is formed to allow the seal insert 14 to be torn with at least a portion of the sealing deck 42 being separated from the cylindrical skirt 36 upon a pulling force being applied to the pull-tab 40 in a direction away from the bottle main cavity 24 before the flange annular bottom surface 48 being disengaged from the neck annular top surface 30. The seal insert 14 is formed of a thermoplastic material and formed via an injection molding process.

The sealed product packaging unit 10 further includes the closure 16 having a closure outer radial surface 50 and an opposing closure inner radial surface 52, and a closure top 54 extending radially interior from and across the closure inner radial surface 52. The closure 16 is attachable to the bottle 12.

Advantageously, the seal insert 14 provides an alternative tamper-evident sealing element for utilization on thermoplastic bottles that traditionally utilize multilayer, planar sealing elements. The seal insert 14 utilizes a non-planar configuration in order to present the eventual consumer (user) with the pull-tab 40 that can be readily leveraged, such as by a single finger, to easily open or unseal the bottle 12. In this regard the pull-tab 40 is considered significantly more ergonomic than prior art planar sealing elements. This solves a major consumer frustration when attempting to access the product in a sealed bottle or container. Furthermore, the seal insert 14 is configured such that it rests upon and seals directly to the neck annular top surface 30 of the bottle 12 independent of the specific neck features of the bottle 12. This ensures the seal insert 14 is non-disruptive to the intended fit and function between a given bottle 12 and its mating closure 16. In this respect, the seal insert 14 provides a better consumer facing tamper-evident sealing solution in comparison to prior art disc-shaped laminated seals that can likewise be implemented directly with commonly available bottle and closure designs. The seal insert 14 thereby avoids requirements of any customized bottle or closure features to achieve the desired sealing. This allows for the seal insert 14 to be sourced from manufacturers independent of the manufacturers of the bottles and closures that that seal insert 14 is ultimately to be used with.

As mentioned above, the flange annular bottom surface 48 is directly molecularly bonded to the neck annular top surface 30 to seal the bottle main cavity 24. The molecular bonding of the flange annular bottom surface 48 includes directing energy into the flange 38. The molecular bonding may be accomplished by any of those methods which are well known to one of ordinary skill in the art, such a conduction of heat, ultrasonic welding, laser welding and spin welding. Conduction of heat may be done by positioning a heating element adjacent the flange annular top surface 46 to effectively melt the thermoplastic material of the flange annular bottom surface 48 to the neck annular top surface 30. Appreciably, the seal insert 14 avoids the introduction of another component or element to facilitate its bond to the bottle 12, such as a prior art sealing element.

Ultrasonic welding may be used to introduce energy into the flange 38 by way of mechanical vibration. To enhance the effectiveness of the molecular bond, prior to attachment, the flange annular bottom surface 48 may include an energy director 64 extending away from the flange annular top surface 46. The energy director 64 may be ring-shaped and extends away from the flange annular top surface 46 to a distal circular apex. This distal circular apex is contemplated to initially melt and adhere to the neck annular top surface 30 to initiate the molecular bonding of the overall flange annular bottom surface 48 to the next annular top surface 30. The distal circular apex is placed against the neck annular top surface 48 during the ultrasonic welding process. Other configurations of the energy director 64 may take the form of discrete protrusions arrayed in a pattern or grid. Laser welding may be used to form the molecular bond by heating the flange annular bottom surface 48. Spin welding techniques may be used to relatively rotate the seal insert 14 and the bottle 12 to cause frictional forces to produce heat between the flange annular bottom surface 48 to the neck annular top surface 30. It is contemplated that the direct molecular bond provides a hermetic seal of the bottle opening 22 in a manner that is tamper evident.

As mentioned above, the bottle 12 is formed of a thermoplastic material. In this regard, the present invention recognizes that commonly sourced and used bottle designs are formed of thermoplastic materials, such as those bottles ubiquitously used in the CPG industry. In order to effectively provide a seal between the bottle 12 and the seal insert 14, the seal insert 14 is directly molecularly bonded to the bottle 12. The present invention specifically requires that the seal insert 14 is formed of a thermoplastic material as the present invention recognizes that an effective seal may be achieved with the thermoplastic material of a bottle 12 with a thermoplastic material of the seal insert 14. The thermoplastic material of the seal insert 14 may be chosen from those which are well known to one of ordinary skill in the art, such as polyethylene (PE) (including various types of PE, such as high density polyethylene (HDPE), high molecular weight polyethylene (UHMW), linear-low-density polyethylene (LLDPE), and low-density polyethylene (LDPE), polypropylene (PP), and polyethylene terephthalate (PET). Further, the thermoplastic material may be a homogenous material of a single thermoplastic material type or a blend of thermoplastic material types. In this regard, the seal insert 14 may be formed of a single unitary piece of material.

Figure 16:
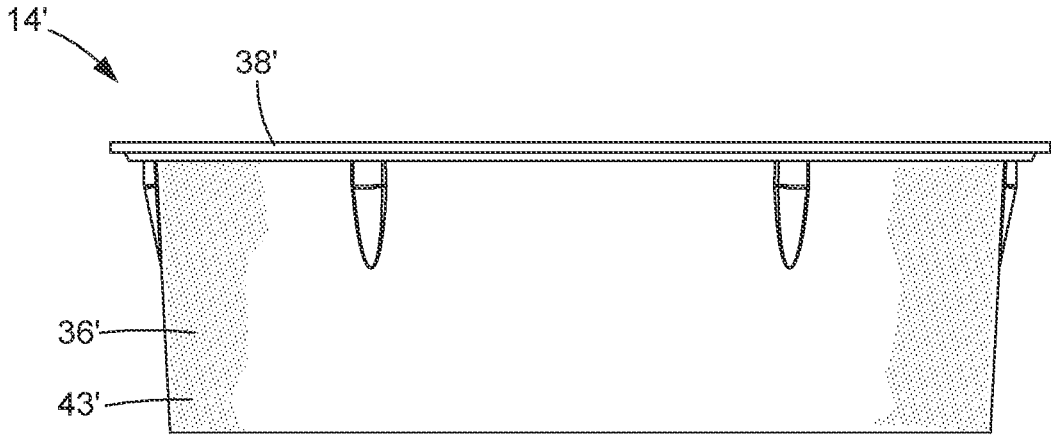
FIG. 16 is a side view similar to FIG. 11, however, with a seal insert according to another embodiment.
Figure 17:
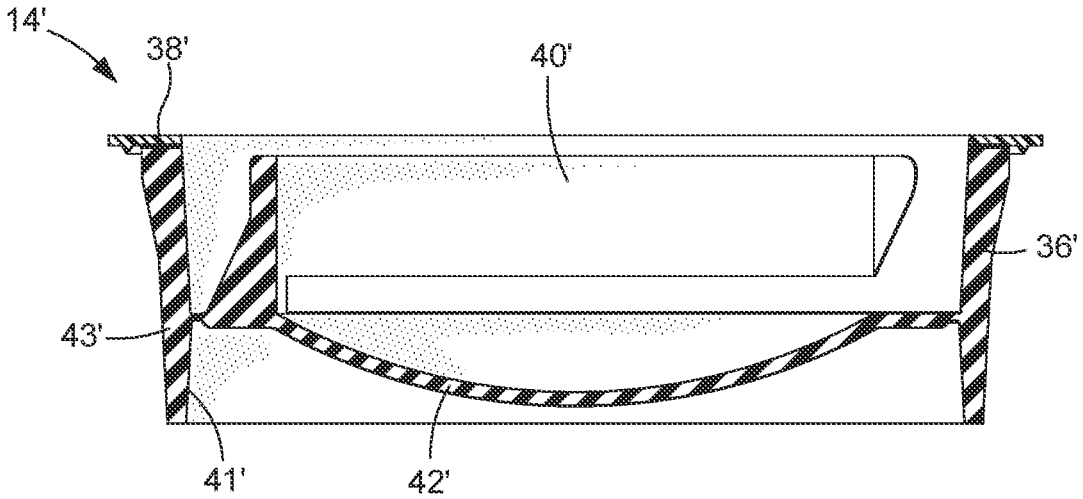
FIG. 17 is a side cross sectional view of the seal insert of FIG. 16.

The thermoplastic material may be a non-homogeneous material, such as with different portions of the seal insert 14 being formed of different thermoplastic materials. These may be formed in the seal insert 14 via various injection mold processes, such as a "two-shot" or multi-shot process, according to any of those methods well known to one of ordinary skill in the art. For example, referring to FIGS. 16 and 17, a seal insert 14' is depicted according to another embodiment. The seal insert 14' includes a cylindrical skirt 36' with an insert inner radial surface 41' and an insert outer radial surface 43', a circular flange 38', a pull-tab 40', and a sealing deck 42'. In this embodiment, the circular flange 38' is formed of a different thermoplastic material than the cylindrical skirt 36', the pull-tab 40' and the sealing deck 42'. For example, the circular flange 38' may be formed of polyethylene terephthalate (PET) and the cylindrical skirt 36', the pull-tab 40' and the sealing deck 42' may be formed of polyethylene (PE). In this regard, polyethylene terephthalate (PET) of the flange 38' may be considered to have a greater bonding characteristic to the bottle 12 and structural stiffness in comparison to polyethylene. The polyethylene of the cylindrical skirt 36' and the sealing deck 42' is contemplated to be comparable easier to be torn when unsealing the seal insert 14'. Also, the polyethylene of the pull-tab 40' facilitates the pull-tab 40' to be flexed when pulled. In another embodiment, where the thermoplastic material may be a non-homogeneous material, such as with different portions of the seal insert 14 being formed of different thermoplastic materials, the circular flange 38' and the cylindrical skirt 36' may be formed of polyethylene terephthalate (PET), and the pull-tab 40' and the sealing deck 42' may be formed of polyethylene (PE).

The seal insert 14 is formed to allow the seal insert 14 to be torn with at least a portion of the sealing deck 42 being separated from the cylindrical skirt 36 upon a pulling force being applied to the pull-tab 40 in a direction away from the bottle main cavity 24 before the flange annular bottom surface 48 being disengaged from the neck annular top surface 30. In this regard, the physical dimensional specifications of the seal insert 14 are particularly selected to allow the tearing or material failure of the seal insert 14 prior to any failure of the molecular bond between the flange annular bottom surface 48 and the neck annular top surface 30.

The bottle 12 and the closure 16 are formed such that the neck outer radial surface 28 and the closure inner radial surface 52 are cooperative formed to engage each other. In this regard the neck outer radial surface 28 may include a neck engagement element 56 and the closure inner radial surface 52 may include a closure engagement element 58.

The neck engagement element 56 and the closure engagement element 58 are formed to engage each other to retain the closure 16 with the bottle 12 to close the bottle opening 22. In the embodiment depicted, the neck engagement element 56 may take the form of outer threads 60, and the closure engagement element 58 may take the form of inner threads 62. The closure 16 may be rotated to attach and remove the closure 16 from the bottle 12. The neck engagement element 56 and the closure engagement element 58 may take other forms such a complimentary ledge that are configured to elastically deform upon the closure 16 being attached to and removed from the bottle 12 such as "pop top" type closures.

Figure 6:
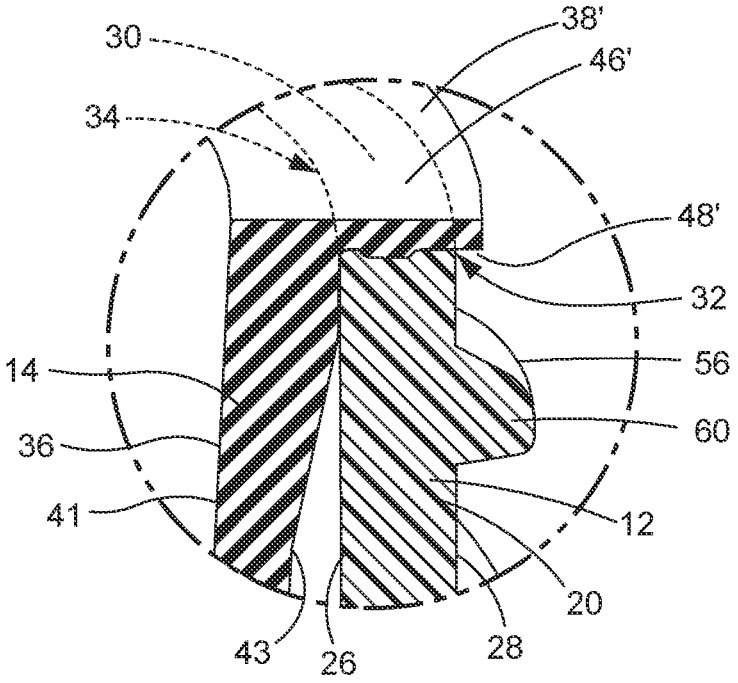
FIG. 6 is an enlarged view similar to FIG. 5, however, with a seal insert according to another embodiment with a flange outer edge extending beyond neck outer edge of the bottle.

The flange outer edge 44 radially extends between the neck inner radial surface 26 and the neck outer radial surface 28 with the seal insert 14 positioned into the neck 20. Referring to FIG. 6, in another embodiment, the flange outer edge 44 radially extends beyond the neck outer radial surface 28 with the seal insert 14 positioned into the neck 20. Further the flange outer edge 44 radially extends the neck outer radial surface 28 and the outer threads 60 with the seal insert 14 positioned into the neck 20.

The seal insert 14 may include centering nubs 66 circumferentially distributed about and extending radially from the insert outer radial surface 43. The centering nubs 66 are configured to contact the neck inner radial surface 26 upon the seal insert 14 being inserted into the neck 20. This facilitates the desired indexing and positioning of the seal insert 14 within the bottle opening 22. Each of the centering nubs 66 extend along the insert outer radial surface 43 away from the circular flange 38, and the centering nubs each are tapered with the tapering being a less radial distance in a direction away from the circular flange 38.

According to an aspect of the invention, there is provided a method of sealing the bottle 12. The method includes providing the bottle 12 and the seal insert 14 as described above. A dispensable product 68 is then filled into the bottle main cavity 24. The dispensable product 68 may take any desired form, such as discrete units (such as pills or tablets), powders, and/or liquids.

Figure 3:
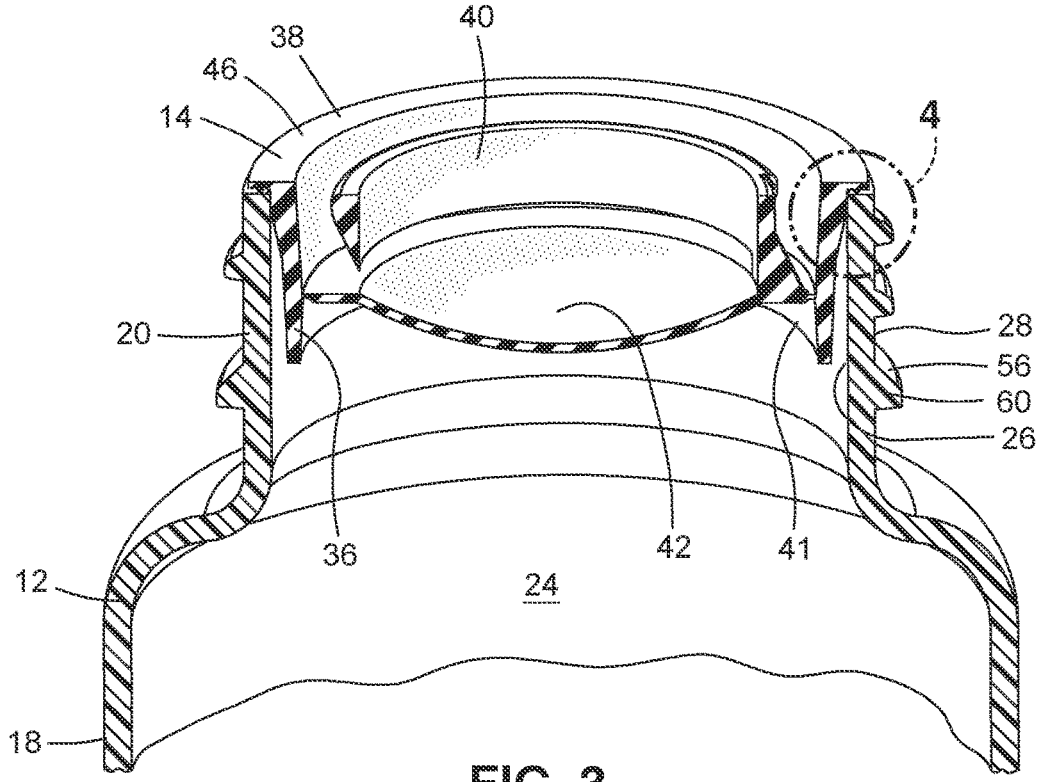
FIG. 3 is a perspective view of a seal insert positioned within a portion of a bottle of the sealed product packaging unit of FIG. 1 as viewed along axis 2-2 of FIG. 1.
Figure 4:
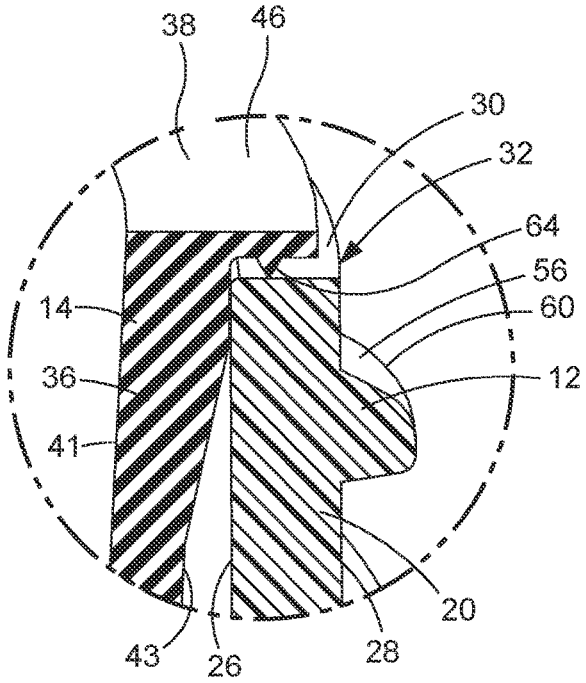
FIG. 4. is an enlarged view of a portion of the seal insert and a portion of the bottle of FIG. 3 as indicated by the region 4.

The method provides for positioning the seal insert 14 into the neck 20 with the cylindrical skirt 36 within the neck inner radial surface 34. It is contemplated that the centering nubs 66 described above may facilitate the centered positioning of the cylindrical skirt 36 in the bottle opening 22 within the neck inner radial surface 26. Further, the cylindrical skirt 36 may be formed with a slight taper with the skirt 36 radially narrowing away from the flange 38 so as to further ease of positioning and alignment of the skirt 36 into the bottle opening 22. The positioning includes placing the flange 38 against the neck annular top surface 30. Where the flange 38 includes an energy director 64, as the ring shaped energy director 64, the energy director 64 is placed against the neck annular top surface 30, such as depicted in FIGS. 3 and 4.

Figure 5:
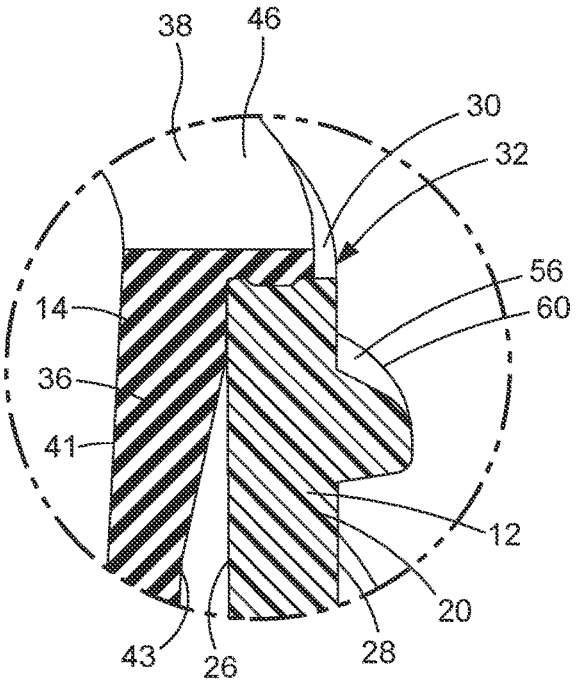
FIG. 5 is the enlarged view of FIG. 4 with the seal insert being molecularly bonded to the bottle.

The method further includes molecular bonding the flange annular bottom surface 48 directly to the neck annular top surface 30 to seal the bottle main cavity 24, such as depicted in FIG. 5. The molecular bonding may result in an effective hermetic seal thereby containing the dispensable product 68 within the bottle with a tamper evident seal. The molecular bonding may be done as described above.

Figure 7:
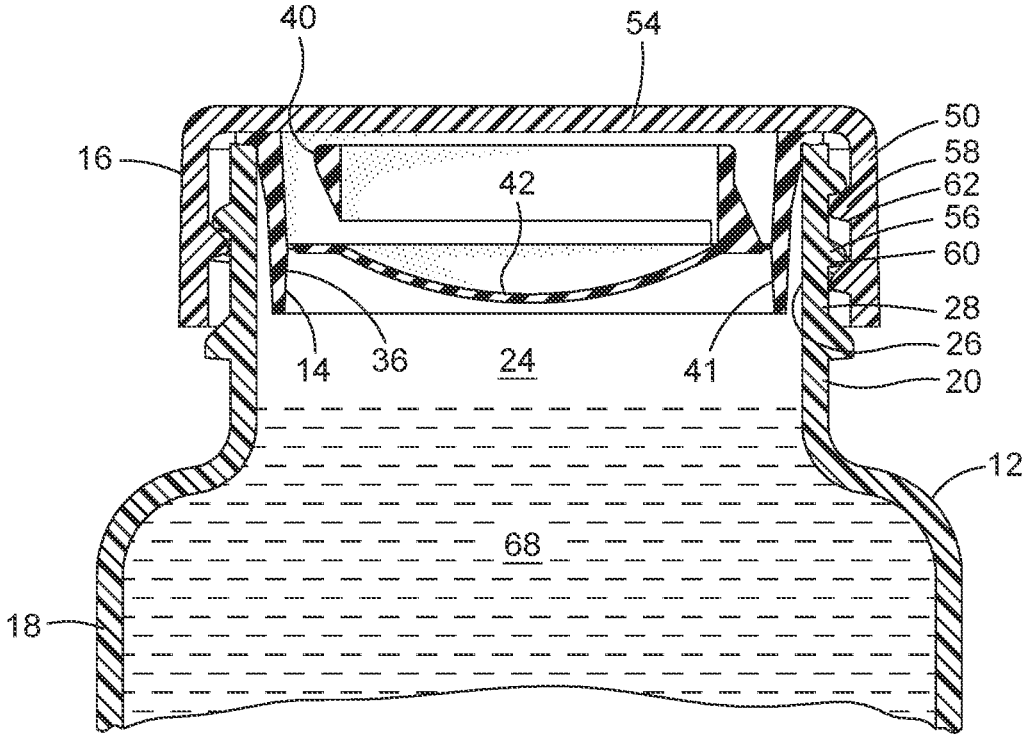
FIG. 7 is a cross-sectional side view of a portion of the bottle with the seal insert and closure attached to the bottle (with dispensable product contained within the bottle as symbolically indicated in dashed hatch lining)
Figure 8:
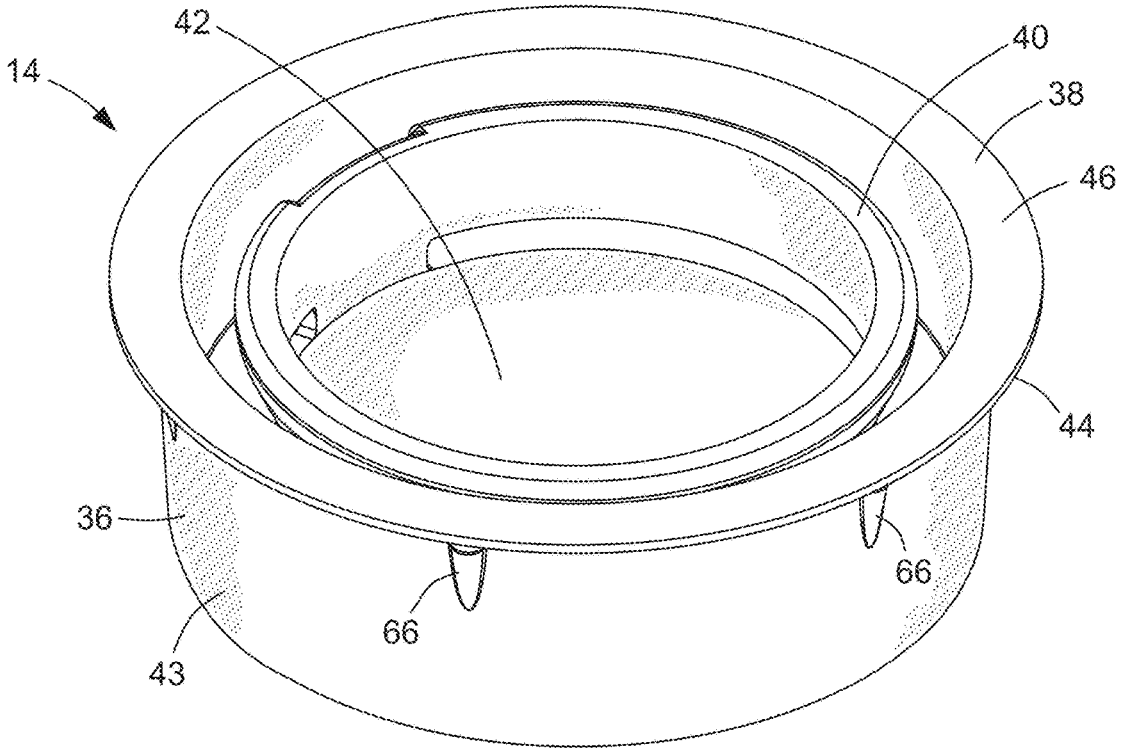
FIG. 8 is a top perspective view of the seal insert.
Figure 9:
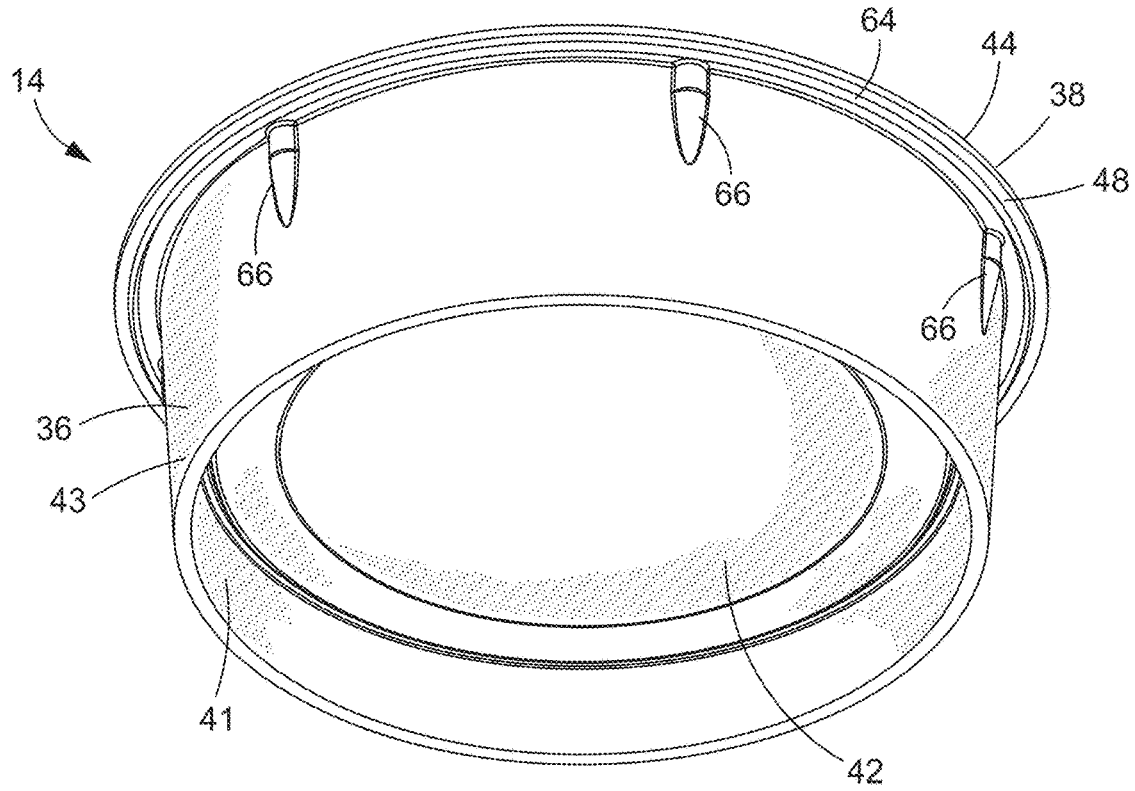
FIG. 9 is a bottom perspective view of the seal insert.
Figure 10:
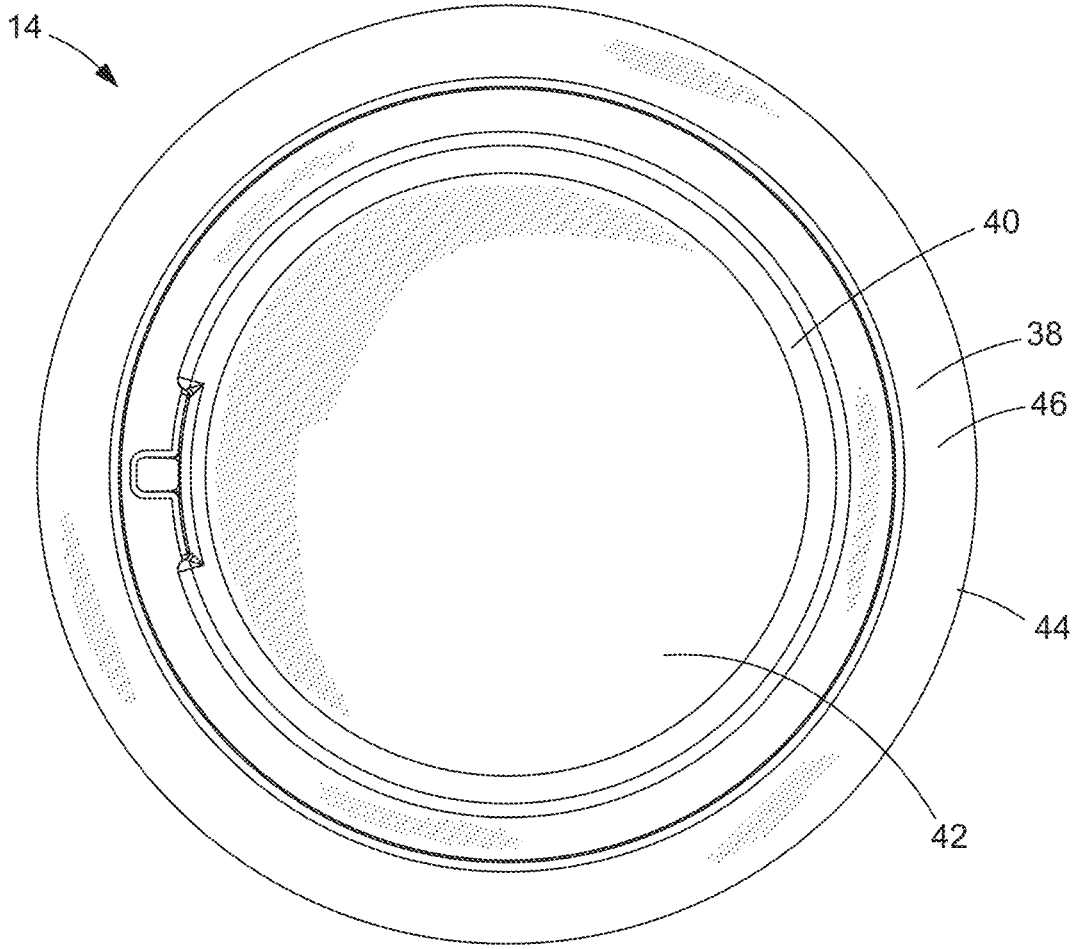
FIG. 10 is a top view of the seal insert.
Figure 11:
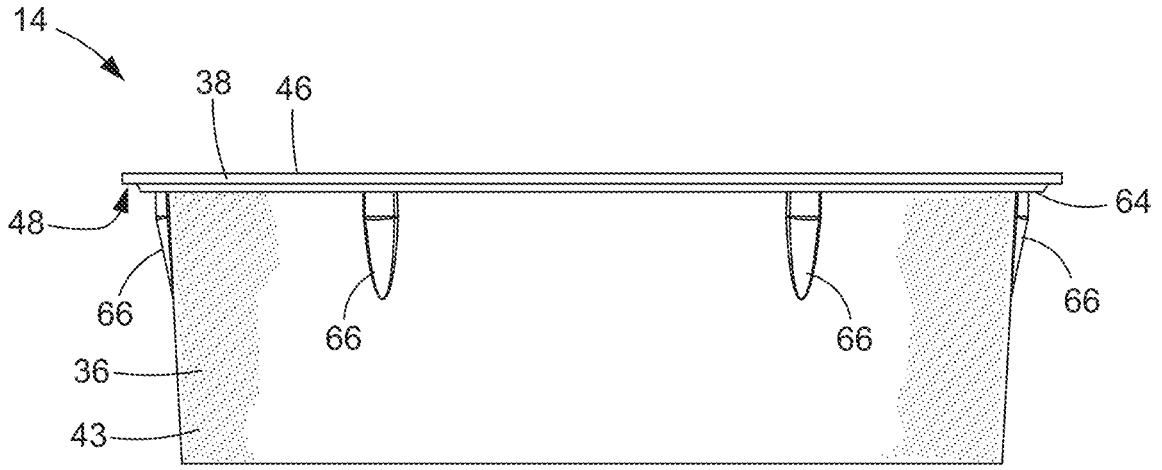
FIG. 11 is a side view of the seal insert.

The method further includes providing the closure 16 and attaching the closure 16 to the bottle 12 by positioning the closure inner radial surface 52 about the neck outer radial surface 28, such as depicted in FIG. 7. With the engagement of the closure 16, this substantially completes the packaging of the sealed product packaging unit 10. It is contemplated additional seals may be further attached to the sealed product packaging unit 10 such as a shrink-wrap seal about the closure 16 and the neck 20 of the bottle 12 to provide another tamper evident seal as may be desired.

Figure 12:
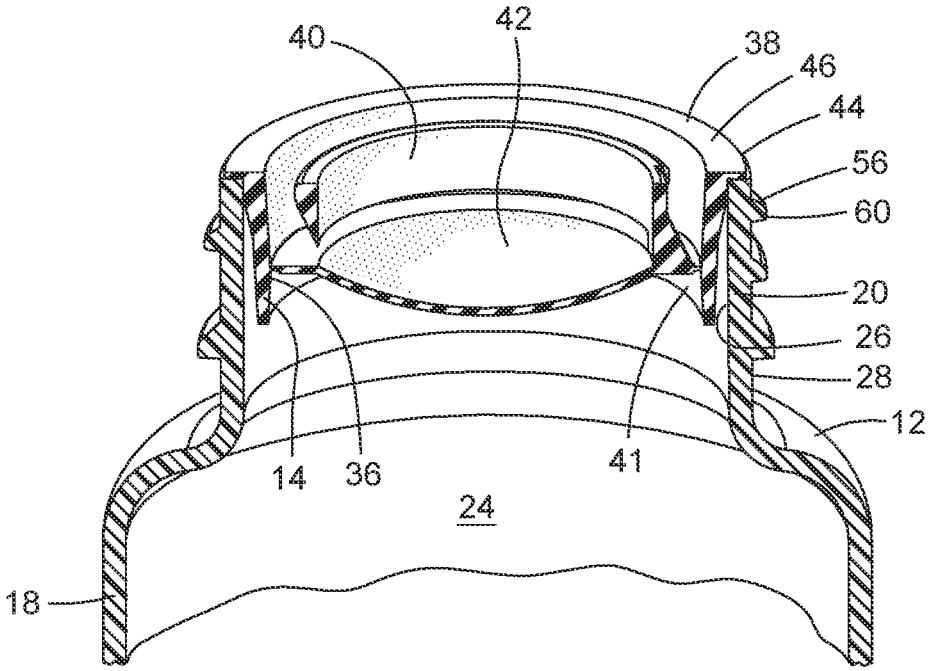
FIG. 12 is a perspective view of the seal insert and the portion of a bottle similar to FIG. 3, however, with the seal insert molecularly bonded to the bottle.
Figure 13:
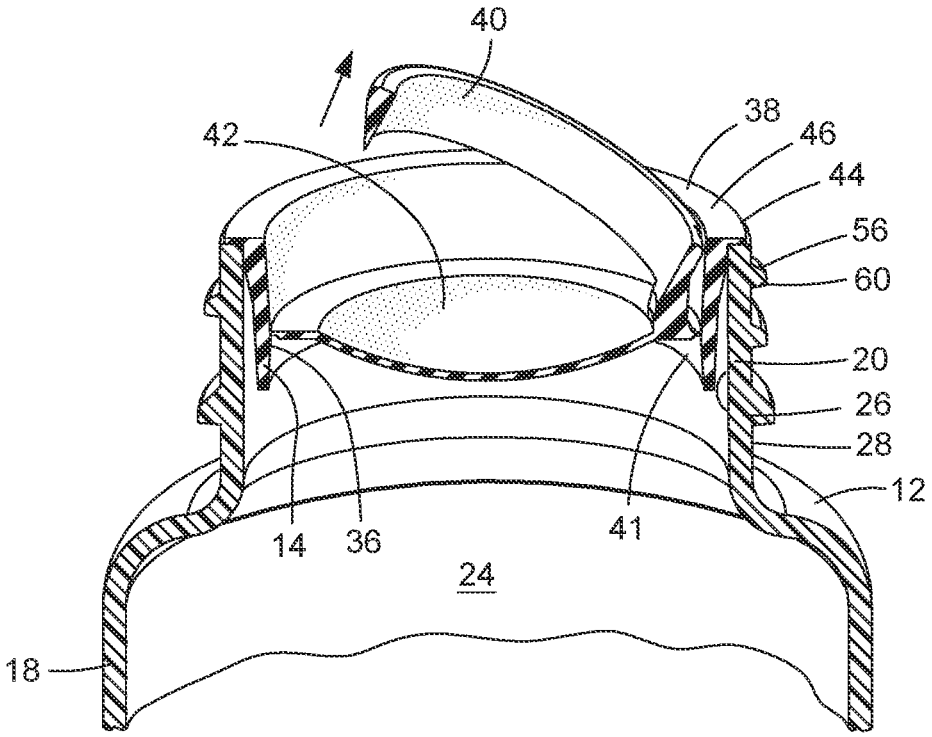
FIG. 13 is a view similar to FIG. 12, however, with a pull-tab being deflected upward.
Figure 14:
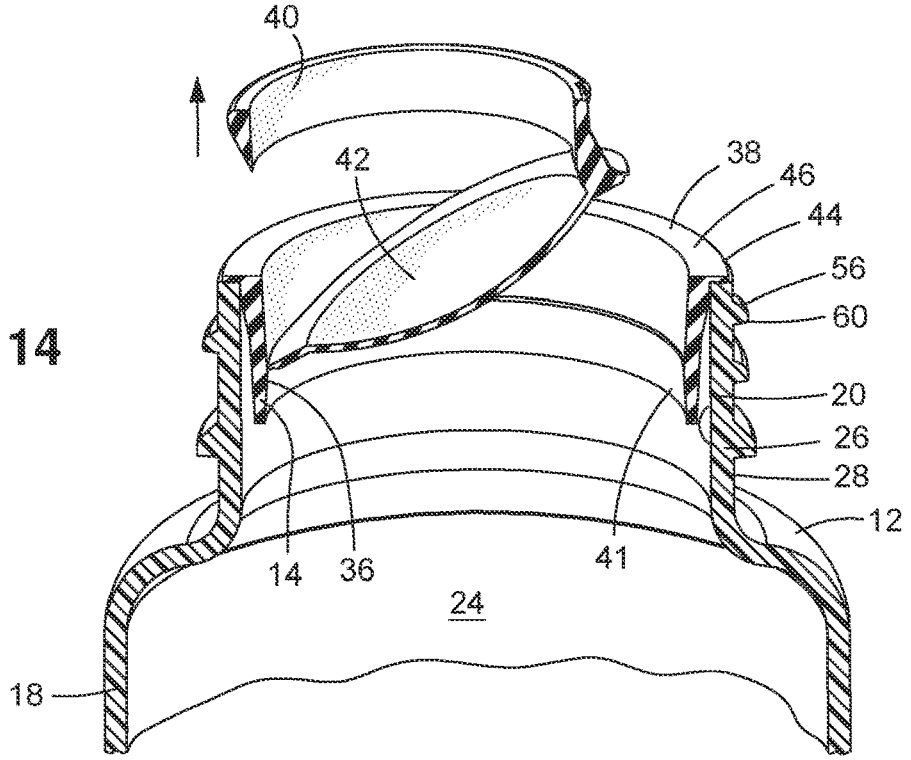
FIG. 14 is a view similar to FIG. 13, however, with a portion of the seal insert having been torn.
Figure 15:
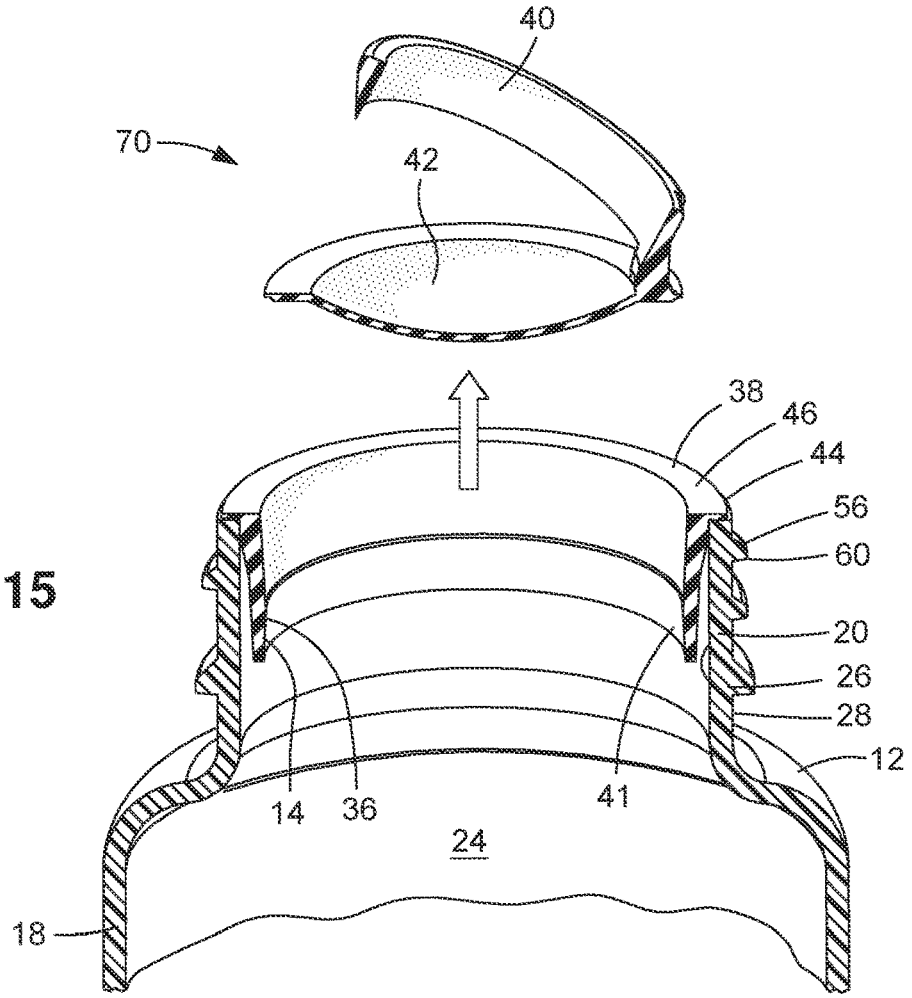
FIG. 15 is a view similar to FIG. 14, however, with a portion of the seal insert being torn away and separated.

In use, it is contemplated that the end user would initially remove the closure 16 from the bottle 12, such as depicted in FIG. 12. Next, the end user would apply a pulling force to the pull-tab 40 to lift the pull-tab 40 in a direction away from the bottle 12, such as depicted in FIG. 13. This pulling force would be continued to be applied with sufficient force so as to begin to tear the seal insert 14, such as depicted in FIG. 14. Finally, the seal insert 14 would be completely torn resulting in a torn section 70 that would include the pull-tab 40 and at least a portion of the sealing deck 42, such as depicted in FIG. 15. This would then allow access to the dispensable product 68 within the bottle 12. After accessing the dispensable product 68, the end user may reseal the bottle 12 may simply reattaching the closure 16 to the bottle 12.

The particulars shown herein are by way of example only for purposes of illustrative discussion, and are presented in the cause of providing what is believed to be the most useful and readily understood description of the principles and conceptual aspects of the various embodiments set forth in the present disclosure. In this regard, no attempt is made to show any more detail than is necessary for a fundamental understanding of the different features of the various embodiments, the description taken with the drawings making apparent to those skilled in the art how these may be implemented in practice.

What is claimed is:

1. A method of sealing a bottle, the method comprising:

providing a bottle having a bottle body, a neck, a bottle opening, and a bottle main cavity extending into the bottle body from the bottle opening, the neck extending from the bottle body, the neck having a neck inner radial surface and an opposing neck outer radial surface, the neck having a neck annular top surface disposed between a neck inner edge and a neck outer edge, the neck outer radial surface extending from the neck outer edge, the neck inner radial surface extending from the neck inner edge, the bottle opening being defined by the neck inner edge, the bottle being formed of a thermoplastic material;

providing a seal insert having a cylindrical skirt, a circular flange, a pull-tab, and a sealing deck, the cylindrical skirt having an insert inner radial surface and an opposing insert outer radial surface, the circular flange radially extending from the insert outer radial surface, the circular flange having a flange outer edge, a flange annular top surface and an opposing flange annular bottom surface, the sealing deck extending across the cylindrical skirt from the insert inner radial surface, the pull-tab extending from the sealing deck within the insert inner radial surface, the seal insert being formed of a thermoplastic material using an injection molding process;

positioning the seal insert into the neck with the cylindrical skirt within the neck inner radial surface;

molecular bonding the thermoplastic material of the flange annular bottom surface directly to the thermoplastic material of the neck annular top surface to seal the bottle main cavity, the seal insert being formed to allow the seal insert to be torn with at least a portion of the sealing deck being separated from the cylindrical skirt upon a pulling force being applied to the pull-tab in a direction away from the bottle main cavity before the flange annular bottom surface being disengaged from the neck annular top surface;

providing a closure, the closure having a closure outer radial surface and an opposing closure inner radial surface, and a closure top extending radially interior from and across the closure inner radial surface, the neck outer radial surface and the closure inner radial surface being cooperatively formed to engage each other; and attaching the closure to the bottle by positioning the closure inner radial surface about the neck outer radial surface.

2. The method of claim 1 wherein the seal insert is formed of polyethylene.

3. The method of claim 1 wherein the seal insert is formed of a single unitary piece of material.

4. The method of claim 1 wherein the seal insert is formed of two types of thermoplastic material.

5. The method of claim 1 wherein the flange and the bottle neck are formed a same type of thermoplastic material.

6. The method of claim 1 wherein the flange outer edge does not radially extend beyond the neck outer radial surface with the seal insert positioned into the neck.

7. The method of claim 1 wherein the molecular bonding of the flange annular bottom surface includes directing energy into the flange.

8. The method of claim 7 wherein the molecular bonding of the flange annular bottom surface includes providing heat to the flange annular top surface.

9. The method of claim 7 wherein the molecular bonding of the flange annular bottom surface includes ultrasonic welding.

10. The method of claim 1 wherein the flange annular bottom surface includes an energy director extending away from the flange annular top surface.

11. The method of claim 10 wherein the energy director is ring-shaped extending away from the flange annular top surface to a distal circular apex.

12. The method of claim 11 wherein the positioning of the seal insert into the neck includes placing the distal circular apex against the neck annular top surface.

13. The method of claim 1 wherein the neck outer radial surface has outer threads extending therefrom and the closure inner radial surface has inner threads extending therefrom, the attaching of the closure to the bottle includes rotating the closure onto the bottle with the outer threads engaged with the inner threads.

14. The method of claim 13 wherein the flange outer edge radially extends between the neck outer radial surface and the outer threads with the seal insert positioned into the neck.

15. The method of claim 1 wherein the seal insert includes centering nubs circumferentially distributed about and extending radially from the insert outer radial surface, the centering nubs contacting the neck inner radial surface upon the seal insert being inserted into the neck.

16. The method of claim 15 wherein each of the centering nubs extend along the insert outer radial surface away from the circular flange, the centering nubs each are tapered with the tapering being a less radial distance in a direction away from the circular flange.

17. The method of claim 1 further includes inserting a dispensable product into the bottle prior to positioning the seal insert into the neck.

18. The method of claim 1 wherein the molecular bonding of the flange annular bottom surface directly to the neck annular top surface forms a hermetic seal of the bottle main cavity.

19. A sealed product packaging unit comprising:

a bottle having a bottle body, a neck, a bottle opening, and a bottle main cavity extending into the bottle body from the bottle opening, the neck extending from the bottle body, the neck having a neck inner radial surface and an opposing neck outer radial surface, the neck having a neck annular top surface disposed between a neck inner edge and a neck outer edge, the neck outer radial surface extending from the neck outer edge, the neck inner radial surface extending from the neck inner edge, the bottle opening being defined by the neck inner edge, the bottle being formed of a thermoplastic material;

a seal insert having a cylindrical skirt, a circular flange, a pull-tab, and a sealing deck, the cylindrical skirt having an insert inner radial surface and an opposing insert outer radial surface, the circular flange radially extending from the insert outer radial surface, the circular flange having a flange outer edge, a flange annular top surface and an opposing flange annular bottom surface, the sealing deck extending across the cylindrical skirt from the insert inner radial surface, the pull-tab extending from the sealing deck within the insert inner radial surface, the seal insert being positioned into the neck with the cylindrical skirt within the neck inner radial surface, the seal insert being formed of an injection molded thermoplastic material using an injection molding process, the thermoplastic material of the flange annular bottom surface being directly molecularly bonded to the thermoplastic material of the neck annular top surface to seal the bottle main cavity, the seal insert being formed to allow the seal insert to be torn with at least a portion of the sealing deck being separated from the cylindrical skirt upon a pulling force being applied to the pull-tab in a direction away from the bottle main cavity before the flange annular bottom surface being disengaged from the neck annular top surface; and a closure having a closure outer radial surface and an opposing closure inner radial surface, and a closure top extending radially interior from and across the closure inner radial surface, the closure being attachable to the bottle.

20. The sealed product packaging unit of claim 19 wherein the seal insert is formed of polyethylene.

21. The sealed product packaging unit of claim 19 wherein the seal insert is formed of a single unitary piece of material.

22. The sealed product packaging unit of claim 19 wherein the seal insert is formed of two types of thermoplastic material.

23. The sealed product packaging using of claim 19 wherein the flange and the bottle neck are formed a same type of thermoplastic material.

24. The sealed product packaging unit of claim 19 wherein the flange outer edge does not radially extend beyond the neck outer radial surface with the seal insert positioned into the neck.

25. The sealed product packaging unit of claim 19 wherein the flange annular bottom surface is directly molecularly bonded to the neck annular top surface by energy being directed into the flange.

26. The sealed product packaging unit of claim 25 wherein the flange annular bottom surface is directly molecularly bonded to the neck annular top surface by heating.

27. The sealed product packaging unit of claim 25 wherein the flange annular bottom surface is directly molecularly bonded to the neck annular top surface by ultrasonic welding.

28. The sealed product packaging unit of claim 19 wherein the neck outer radial surface has outer threads extending therefrom, the flange outer edge radially extends between the neck outer radial surface and the outer threads with the seal insert positioned into the neck.

29. The sealed product packaging unit of claim 19 wherein the seal insert includes centering nubs circumferentially distributed about and extending radially from the insert outer radial surface, the centering nubs contacting the neck inner radial surface upon the seal insert being inserted into the neck.

30. The sealed product packaging unit of claim 29 wherein each of the centering nubs extend along the insert outer radial surface away from the circular flange, the centering nubs each are tapered with the tapering being a less radial distance in a direction away from the circular flange.

31. A method of sealing a bottle, the method comprising:

providing a bottle having a bottle body, a neck, a bottle opening, and a bottle main cavity extending into the bottle body from the bottle opening, the neck extending from the bottle body, the neck having a neck inner radial surface and an opposing neck outer radial surface, the neck having a neck annular top surface disposed between a neck inner edge and a neck outer edge, the neck outer radial surface extending from the neck outer edge, the neck inner radial surface extending from the neck inner edge, the bottle opening being defined by the neck inner edge, the bottle being formed of a thermoplastic material;

providing a seal insert having a cylindrical skirt, a circular flange, a pull-tab, and a sealing deck, the cylindrical skirt having an insert inner radial surface and an opposing insert outer radial surface, the circular flange radially extending from the insert outer radial surface, the circular flange having a flange outer edge, a flange annular top surface and an opposing flange annular bottom surface, the sealing deck extending across the cylindrical skirt from the insert inner radial surface, the pull-tab extending from the sealing deck within the insert inner radial surface, the seal insert being formed of a thermoplastic material using an injection molding process;

positioning the seal insert into the neck with the cylindrical skirt within the neck inner radial surface;

molecular bonding the flange annular bottom surface directly to the neck annular top surface to seal the bottle main cavity, the molecular bonding includes providing heat to the flange annular top surface, the seal insert being formed to allow the seal insert to be torn with at least a portion of the sealing deck being separated from the cylindrical skirt upon a pulling force being applied to the pull-tab in a direction away from the bottle main cavity before the flange annular bottom surface being disengaged from the neck annular top surface;

providing a closure, the closure having a closure outer radial surface and an opposing closure inner radial surface, and a closure top extending radially interior from and across the closure inner radial surface, the neck outer radial surface and the closure inner radial surface being cooperatively formed to engage each other; and attaching the closure to the bottle by positioning the closure inner radial surface about the neck outer radial surface.

32. A method of sealing a bottle, the method comprising:

providing a bottle having a bottle body, a neck, a bottle opening, and a bottle main cavity extending into the bottle body from the bottle opening, the neck extending from the bottle body, the neck having a neck inner radial surface and an opposing neck outer radial surface, the neck having a neck annular top surface disposed between a neck inner edge and a neck outer edge, the neck outer radial surface extending from the neck outer edge, the neck inner radial surface extending from the neck inner edge, the bottle opening being defined by the neck inner edge, the bottle being formed of a thermoplastic material;

providing a seal insert having a cylindrical skirt, a circular flange, a pull-tab, and a sealing deck, the cylindrical skirt having an insert inner radial surface and an opposing insert outer radial surface, the circular flange radially extending from the insert outer radial surface, the circular flange having a flange outer edge, a flange annular top surface and an opposing flange annular bottom surface, the flange annular bottom surface includes a ring-shaped energy director extending away from the flange annual top surface to a distal circular apex, the sealing deck extending across the cylindrical skirt from the insert inner radial surface, the pull-tab extending from the sealing deck within the insert inner radial surface, the seal insert being formed of a thermoplastic material using an injection molding process;

positioning the seal insert into the neck with the cylindrical skirt within the neck inner radial surface;

molecular bonding the flange annular bottom surface directly to the neck annular top surface to seal the bottle main cavity, the seal insert being formed to allow the seal insert to be torn with at least a portion of the sealing deck being separated from the cylindrical skirt upon a pulling force being applied to the pull-tab in a direction away from the bottle main cavity before the flange annular bottom surface being disengaged from the neck annular top surface;

providing a closure, the closure having a closure outer radial surface and an opposing closure inner radial surface, and a closure top extending radially interior from and across the closure inner radial surface, the neck outer radial surface and the closure inner radial surface being cooperatively formed to engage each other; and attaching the closure to the bottle by positioning the closure inner radial surface about the neck outer radial surface.

33. A method of sealing a bottle, the method comprising:

providing a bottle having a bottle body, a neck, a bottle opening, and a bottle main cavity extending into the bottle body from the bottle opening, the neck extending from the bottle body, the neck having a neck inner radial surface and an opposing neck outer radial surface, the neck having a neck annular top surface disposed between a neck inner edge and a neck outer edge, the neck outer radial surface extending from the neck outer edge, the neck inner radial surface extending from the neck inner edge, the bottle opening being defined by the neck inner edge, the bottle being formed of a thermoplastic material;

providing a seal insert having a cylindrical skirt, a circular flange, a pull-tab, and a sealing deck, the cylindrical skirt having an insert inner radial surface and an opposing insert outer radial surface, the circular flange radially extending from the insert outer radial surface, the circular flange having a flange outer edge, a flange annular top surface and an opposing flange annular bottom surface, the sealing deck extending across the cylindrical skirt from the insert inner radial surface, the pull-tab extending from the sealing deck within the insert inner radial surface, the seal insert being formed of a thermoplastic material using an injection molding process, the seal insert includes centering nubs circumferentially distributed about and extending radially from the insert outer radial surface, each of the centering nubs extend along the insert outer radial surface away from the circular flange, the centering nubs each are tapered with the tapering being a less radial distance in a direction away from the circular flange;

positioning the seal insert into the neck with the cylindrical skirt within the neck inner radial surface, the centering nubs contacting the neck inner radial surface upon the seal insert being inserted into the neck;

molecular bonding the flange annular bottom surface directly to the neck annular top surface to seal the bottle main cavity, the seal insert being formed to allow the seal insert to be torn with at least a portion of the sealing deck being separated from the cylindrical skirt upon a pulling force being applied to the pull-tab in a direction away from the bottle main cavity before the flange annular bottom surface being disengaged from the neck annular top surface;

providing a closure, the closure having a closure outer radial surface and an opposing closure inner radial surface, and a closure top extending radially interior from and across the closure inner radial surface, the neck outer radial surface and the closure inner radial surface being cooperatively formed to engage each other; and attaching the closure to the bottle by positioning the closure inner radial surface about the neck outer radial surface.

34. A sealed product packaging unit comprising:

a bottle having a bottle body, a neck, a bottle opening, and a bottle main cavity extending into the bottle body from the bottle opening, the neck extending from the bottle body, the neck having a neck inner radial surface and an opposing neck outer radial surface, the neck having a neck annular top surface disposed between a neck inner edge and a neck outer edge, the neck outer radial surface extending from the neck outer edge, the neck inner radial surface extending from the neck inner edge, the bottle opening being defined by the neck inner edge, the bottle being formed of a thermoplastic material;

a seal insert having a cylindrical skirt, a circular flange, a pull-tab, and a sealing deck, the cylindrical skirt having an insert inner radial surface and an opposing insert outer radial surface, the circular flange radially extending from the insert outer radial surface, the circular flange having a flange outer edge, a flange annular top surface and an opposing flange annular bottom surface, the sealing deck extending across the cylindrical skirt from the insert inner radial surface, the pull-tab extending from the sealing deck within the insert inner radial surface, the seal insert being positioned into the neck with the cylindrical skirt within the neck inner radial surface, the flange annular bottom surface being directly molecularly bonded to the neck annular top surface to seal the bottle main cavity, the seal insert being formed to allow the seal insert to be torn with at least a portion of the sealing deck being separated from the cylindrical skirt upon a pulling force being applied to the pull-tab in a direction away from the bottle main cavity before the flange annular bottom surface being disengaged from the neck annular top surface, the seal insert being formed of an injection molded thermoplastic material using an injection molding process, the seal insert including centering nubs circumferentially distributed about and extending radially from the insert outer radial surface, the centering nubs contacting the neck inner radial surface upon the seal insert being inserted into the neck, each of the centering nubs extending along the insert outer radial surface away from the circular flange, the centering nubs each being tapered with the tapering being a less radial distance in a direction away from the circular flange; and a closure having a closure outer radial surface and an opposing closure inner radial surface, and a closure top extending radially interior from and across the closure inner radial surface, the closure being attachable to the bottle.

* * * * *